US005850702A

United States Patent [19]

Okajima

[11] Patent Number: 5,850,702

[45] Date of Patent: Dec. 22, 1998

[54] SNOWBOARD BOOT SOLE

[75] Inventor: Shinpei Okajima, Izumi, Japan

[73] Assignee: Shimano, Inc., Osaka, Japan

[21] Appl. No.: 856,343

[22] Filed: May 14, 1997

[30] Foreign Application Priority Data

Jun. 19, 1996 [JP] Japan ..... 8-178634

[51] Int. Cl.[6] ..... A43B 13/14; A43B 5/00; A43B 23/00

[52] U.S. Cl. ..... 36/31; 36/115; 36/117.3; 36/107

[58] Field of Search ..... 36/31, 115, 117.3, 36/76 R, 131, 107, 108

[56] References Cited

U.S. PATENT DOCUMENTS

| | | | |
|---|---|---|---|
| 3,939,583 | 2/1976 | Daumann . | |
| 4,864,739 | 9/1989 | Maestri | 36/31 |
| 5,054,807 | 10/1991 | Fauvet | 280/607 |
| 5,086,575 | 2/1992 | Bonaventure | 36/117.3 |
| 5,293,702 | 3/1994 | Miyoshi et al. | 36/117.3 |
| 5,452,526 | 9/1995 | Collins | 36/108 |
| 5,520,406 | 5/1996 | Anderson et al. | 280/14.2 |

FOREIGN PATENT DOCUMENTS

| | | | |
|---|---|---|---|
| 2705248 | 11/1994 | France | 36/115 |
| 3804441 | 8/1989 | Germany | 36/31 |
| 4138801 | 5/1993 | Germany | 36/117.3 |

*Primary Examiner*—M. D. Patterson
*Attorney, Agent, or Firm*—James A. Deland

[57] ABSTRACT

A sole core formed in the shape of a strip is disposed longitudinally along a central portion of the sole and functions as an axis of rotation with torsional flexibility. More specifically, in one embodiment of the present invention, a sole for a snowboard boot includes a middle sole core member extending with the sole along a longitudinal center core line (T), wherein a left edge the middle sole core member is spaced apart from a left lateral edge of the sole, and wherein a right edge of the middle sole core member is spaced apart from a right lateral edge of the sole. If desired, the center core line (T) may be inclined relative to the longitudinal centerline of the boot. Separate or connected left and right sole core members may be formed on the left and right sides of the middle sole core member, respectively.

17 Claims, 6 Drawing Sheets

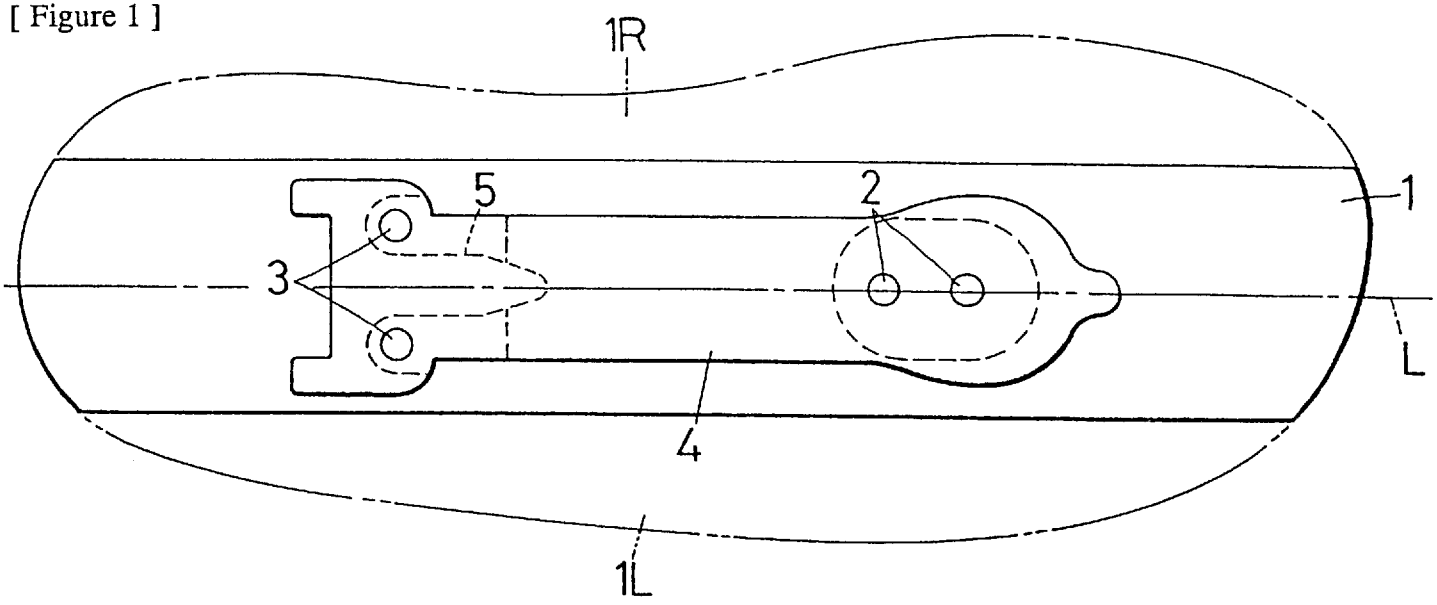
[ Figure 1 ]

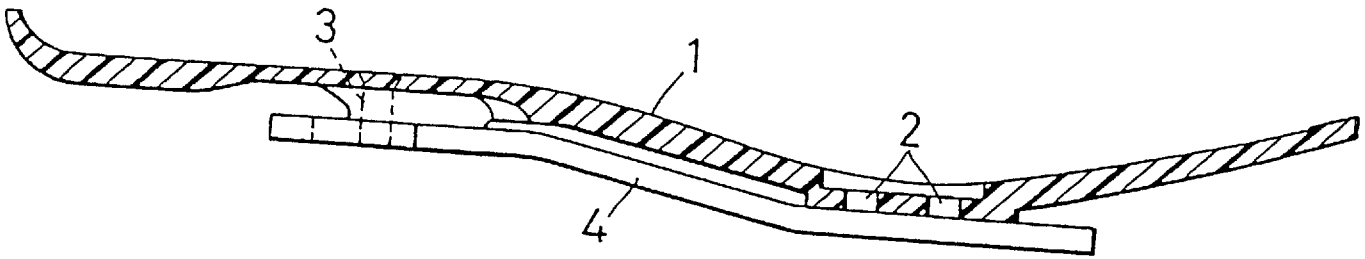
[ Figure 2 ]

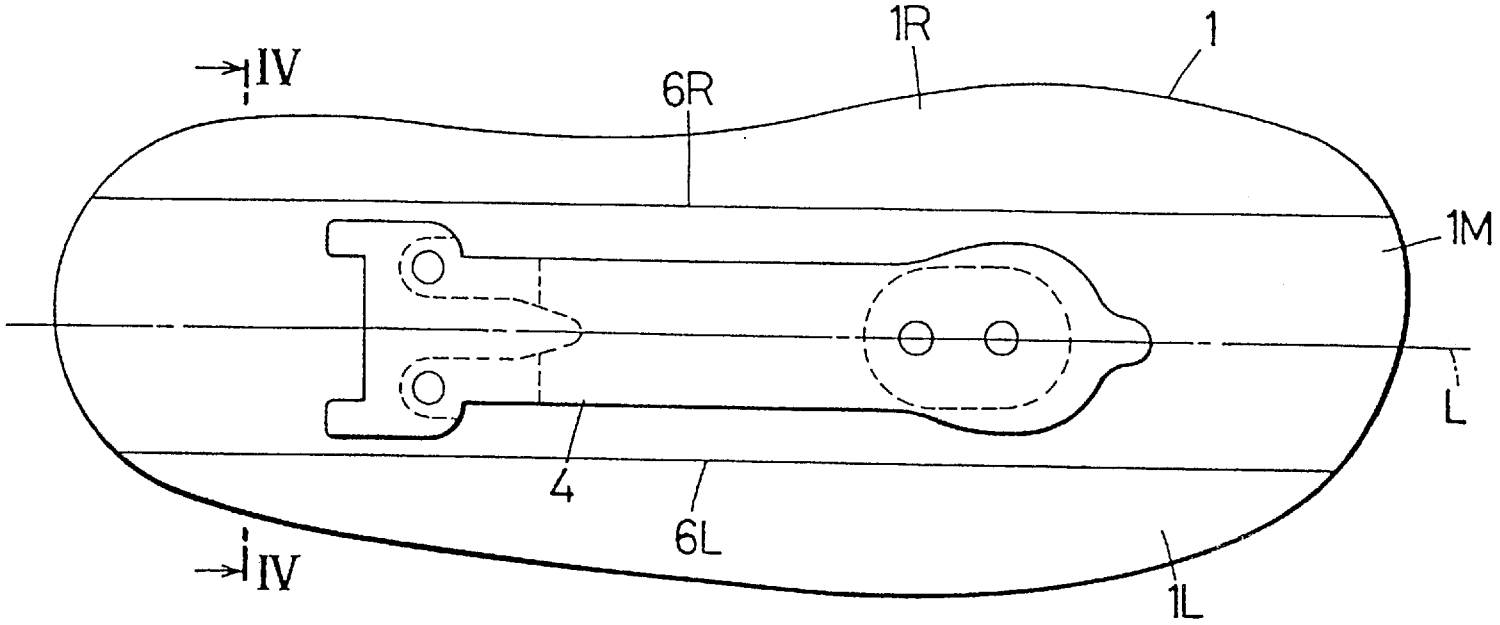
[ Figure 3 ]
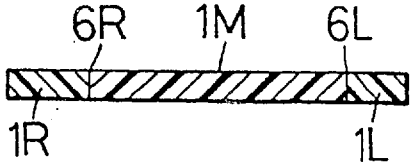
[ Figure 4 ]

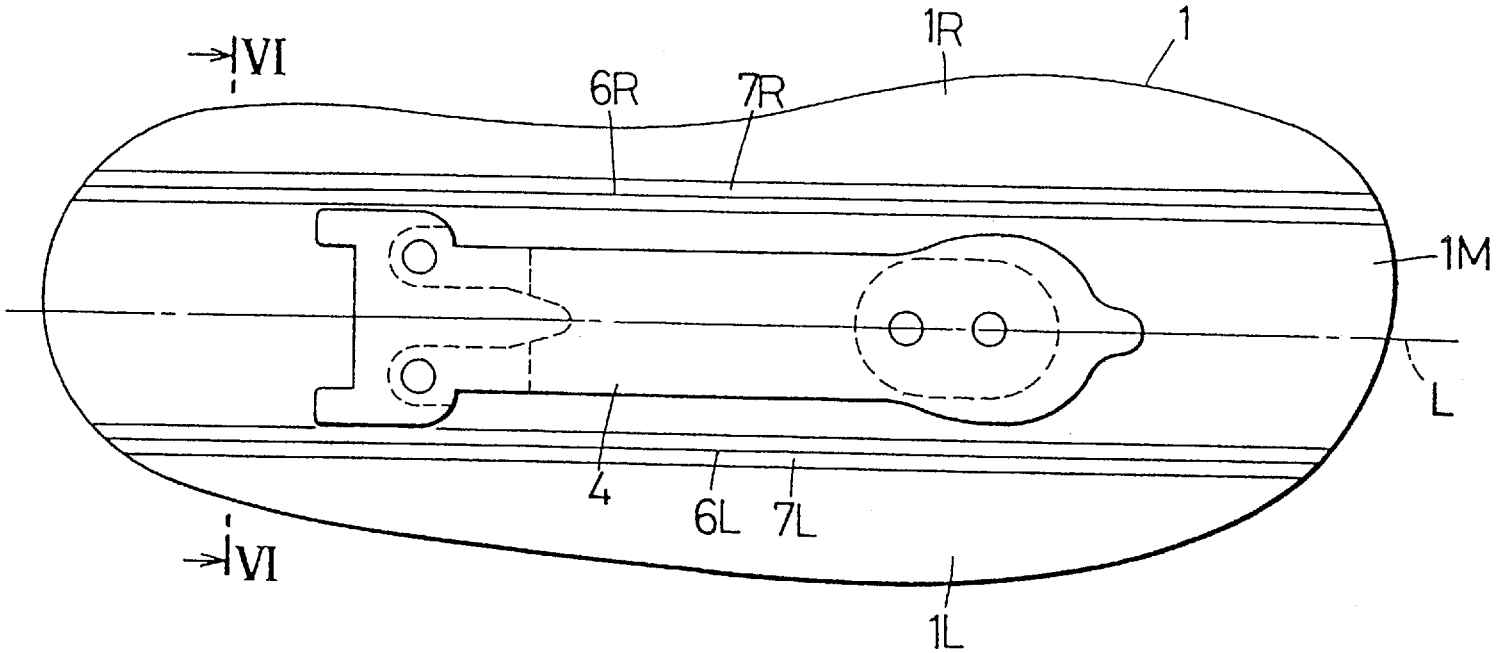
[ Figure 5 ]
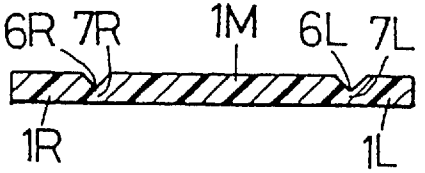
[ Figure 6 ]

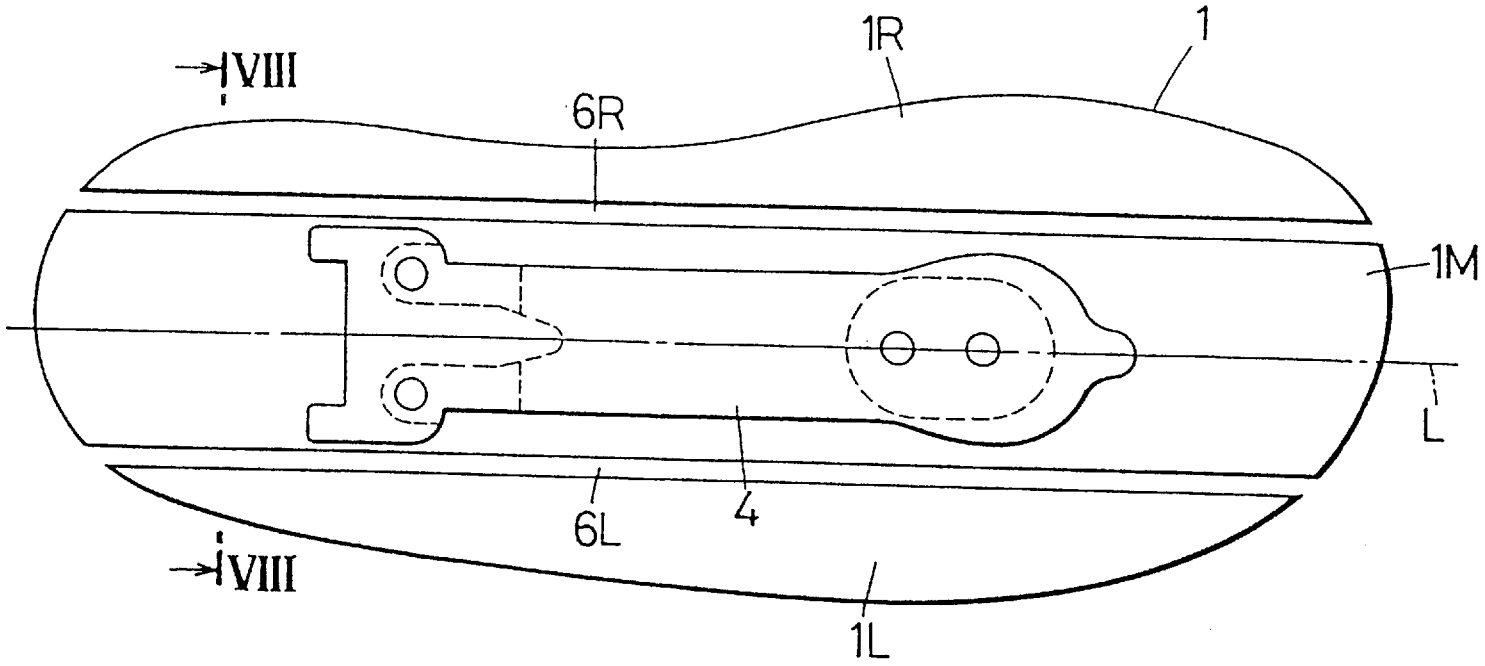
[ Figure 7 ]
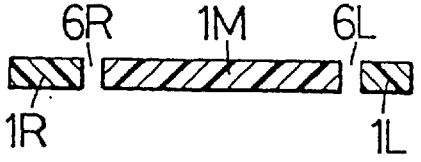
[ Figure 8 ]

[ Figure 9 ]
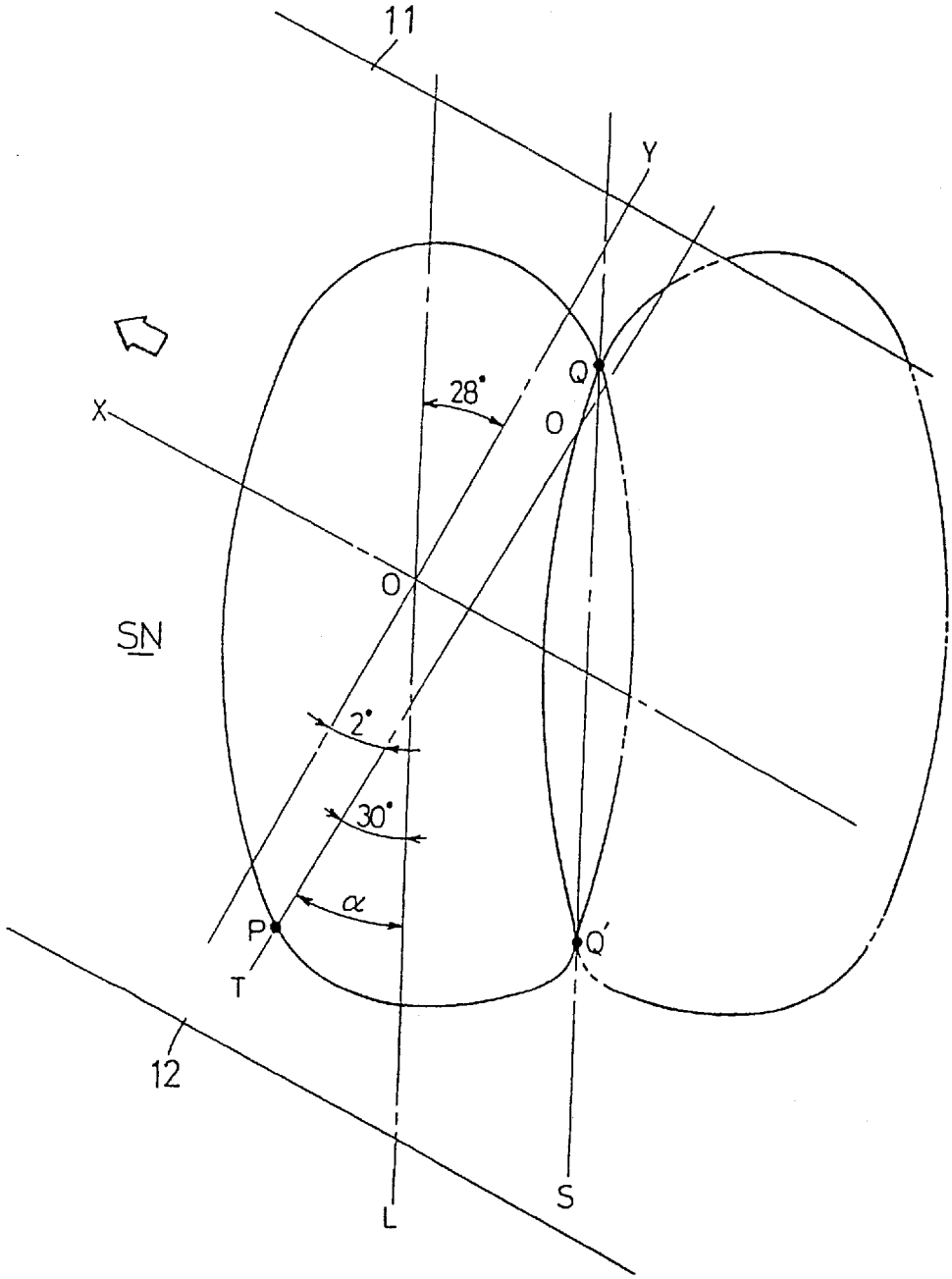

SNOWBOARD BOOT SOLE

BACKGROUND OF THE INVENTION

The present invention is directed to snowboard boots and, more particularly, to a snowboard boot sole.

Snowboarding is similar to water surfing in that a single snowboard is commonly used, as opposed to the use of a pair of skis. A rider is positioned roughly sideways when riding a snowboard, wherein the traveling direction of the snowboard and the longitudinal direction of the rider are roughly orthogonal to each other. During riding, snowboard boots are required to be immovable relative to the snowboard yet flexible. More specifically, the snowboard boots and the feet should be fixed immovably and securely to the snowboard, whereas the ankles should have tiltable flexibility with respect to the boot soles.

Ankle flexibility for the sporting event called the half pipe must be such that the ankle is allowed to tilt in the forward and backward directions of the snowboard. Furthermore, the feet should be allowed to tilt in mutually opposite directions. Another idea that gained acceptance is that the ankles should be allowed to freely tilt in the crosswise direction, and when the two ankles move closer to each other, that is, inward, free tilting of the ankles in the longitudinal direction, and particularly forward, should be allowed.

There are structures for endowing snowboard boots with the ability to tilt in the crosswise direction of the feet or ankles. For example, the heel portion and the upper portion (foot portion), which is located above the heel portion and which supports the ankle, can rotate relative to each other around a center line aligned with the longitudinal direction of the foot. However, a drawback of such snowboard boot structures is that the crosswise tilting of the ankles lacks smoothness when such structures are used alone. Another drawback is that improved motor skills require a higher degree of movement versatility.

In snowboarding, the expression "the longitudinal direction of the rider is roughly orthogonal to the traveling direction of the snowboard" has a special meaning. When the snowboard travels to the left of the rider, the left foot is more active for propelling the snowboard. In this case, the snowboard boots are attached to the snowboard in such a way that the approximate center line of the left foot (the term "center line" will be defined later in the specification) is inclined with respect to the orthogonal drawn to the major axis of the snowboard. More specifically, the left snowboard boot is disposed in such a way that its front portion is positioned in front of the back portion in the travel direction of the snowboard. The inventor also discovered that the tilting of the snowboard boots in which the feet are inclined in the direction of the major axis of the snowboard must be taken into account.

SUMMARY OF THE INVENTION

The present invention is directed to a snowboard boot that makes it easier for a foot to lean in the traveling direction without compromising the boot's ability to tilt in the cross wise direction. In general, a sole core formed in the shape of a strip is disposed longitudinally along a central portion of the sole and functions as an axis of rotation with torsional flexibility. More specifically, in one embodiment of the present invention, a sole for a snowboard boot includes a sole core member extending with the sole along a longitudinal center core line (T), wherein a left edge the sole core member is spaced apart from a left lateral edge of the sole, and wherein a right edge of the sole core member is spaced apart from a right lateral edge of the sole. If desired, the center core line (T) may be inclined relative to the longitudinal centerline of the boot.

In another embodiment of the present invention, the sole core may be shaped much like the sole itself. In this case the sole for the snowboard boot includes a central sole core member extending with the sole along a longitudinal center core line (T), a left side sole core member extending with the sole along a left side of the central core member, and a right side sole core member extending with the sole along a right side of the central core member. To facilitate rotation of the foot, the central sole core member is harder than the left side sole core member and the right side sole core member. If desired, a left joint may connect the central sole core member to the left side sole core member, wherein the left joint is thinner than the central sole core member and the left side sole core member, and a right joint may connect the central sole core member to the right side sole core member, wherein the right joint is thinner than the central sole core member and the right side sole core member.

In yet another embodiment of the present invention, a sole for a snowboard boot includes a central sole core member extending with the sole along a longitudinal center core line (T), a left side sole core member extending with the sole along a left side of the central core member, and a right side sole core member extending with the sole along a right side of the central core member. In this embodiment the central sole core member is separated from the left side sole core member and the right side sole core member and, if desired, the central sole core member, the left side sole core member and the right side sole core member may be formed from the same material.

BRIEF DESCRIPTION OF THE DRAWINGS

FIG. 1 is a plan view of a particular embodiment of a snowboard boot sole according to the present invention;

FIG. 2 is a side cross sectional view of the snowboard boot sole shown in FIG. 1;

FIG. 3 is a is a plan view of an alternative embodiment of a snowboard boot sole according to the present invention;

FIG. 4 is a cross sectional view of the sole core taken along line IV—IV in FIG. 3;

FIG. 5 is a is a plan view of another alternative embodiment of a snowboard boot sole according to the present invention;

FIG. 6 is a cross sectional view of the sole core taken along line VI—VI in FIG. 5;

FIG. 7 is a is a plan view of another alternative embodiment of a snowboard boot sole according to the present invention;

FIG. 8 is a cross sectional view of the sole core taken along line VIII—VIII in FIG. 7; and FIG. 9 is a plan view illustrating a positional relationship between a snowboard and a snowboard boot.

DETAILED DESCRIPTION OF THE EMBODIMENTS

FIG. 1 is a plan view of a particular embodiment of a snowboard boot sole according to the present invention, and FIG. 2 is a side cross sectional view of the snowboard boot sole shown in FIG. 1. In general, a boot sole generally comprises a stiff core sole portion, a stiff heel portion, and a stiff toe portion. The stiff core material is covered with a sole lining portion made of a soft material or with some other coating material. Cleats are joined to the snowboard with the aid of engagement mechanisms (not shown). The cleats are fixed to snowboard boots and are required to allow left and right ankles to lean in the traveling direction or to allow the ankles to lean inward toward each other while being tilted forward. Such engagement mechanisms include those in which engagement is accomplished automatically by stepping with snowboard boots on the snowboard. FIG. 1 depicts a cleat position structure for a snowboard boot that is required to allow the ankle to lean in the approximate direction of the major axis of the snowboard and that comprises a resin sole core member and a cleat that is joined to the resin sole core member and that is joined to the snowboard with the aid of an engagement mechanism.

The sole core member 1, which is shown in the plan view, has a smaller surface area than a conventional sole core member. The sole core member 1 shown is for the left foot, and a hypothetical line (two-dot chain line) indicates the outline of a conventionally configured boot sole. The sole core member 1 is a stiff member for supporting only the middle portion of the foot sole. As shown in FIG. 1, the sole core member 1 does not have the left side portion 1L or right side portion 1R of the conventional sole core member. The sole core member 1 is injection-molded using nylon or another engineering plastic. The rigid resin is harder than the material for the soles joined to the bottom surface and upper surface of the sole core member 1 or than the material for the members, uppers, and other components that cover the soles. The front and back portions of the sole core member 1 are provided with cleat attachment holes 2 and cleat attachment holes 3 arranged in pairs in the longitudinal direction and crosswise direction, respectively.

Symbol L denotes an approximate center line going in the longitudinal direction along the foot sole positioned on the sole core member 1. A cleat 4 is fixed to the sole core member 1 with the aid of bolts or other fixing means (not shown) passing through the cleat attachment holes 2 and 3. The longitudinally directed line related to the traveling direction and drawn through the approximate center positions of the cleat attachment holes 2 and cleat attachment holes 3 coincides with the center line L. The cleat 4 has a larger dimension in the longitudinal direction (traveling direction of the snowboard). The front portion of the cleat 4 is fixed with bolts passing through the cleat attachment holes 2, and the back portion of the cleat 4 is fixed with bolts passing through the cleat attachment holes 3. The sole core member 1 supports only the middle portion of the sole of one foot. The member 5 shown by the broken line in FIG. 1 indicates the position of the engagement member fixed to the snowboard.

FIG. 3 is a is a plan view of an alternative embodiment of a snowboard boot sole according to the present invention, and FIG. 4 is a cross sectional view of the sole core taken along line IV—IV in FIG. 3. In this embodiment, the overall shape of the sole core member 1 is essentially the same as that of a conventional member. The sole core member 1 is divided into three portions in the two positions occupied by left and right lateral lines 6L and 6R, which are shifted to the left and right from the center line L. More specifically, the sole core member 1 comprises a middle portion 1M, which is the portion of the sole core member to which the cleat 4 is firmly attached, an outside left-hand portion 1L, and an inside right-hand portion 1R, which are separated by the left and right lateral lines 6L and 6R.

The cleat 4 is directly fixed to the middle portion 1R. The right-hand portion 1R and the left-hand portion 1L are injection-molded integrally with the middle portion 1M. In this embodiment, the middle portion 1M is molded by the monolithic injection molding of a material that is different from and harder than that of the left-hand portion 1L or right-hand portion 1R.

FIG. 5 is a is a plan view of another alternative embodiment of a snowboard boot sole according to the present invention, and FIG. 6 is a cross sectional view of the sole core taken along line VI—VI in FIG. 5. In this embodiment, the overall shape of the sole core member 1 is essentially the same as that of a conventional member. The sole core member 1 is divided into three portions in the two positions occupied by left and right lateral lines 6L and 6R, which are shifted to the left and right from the center line L. More specifically, the sole core member 1 comprises a middle portion 1M, which is the portion of the sole core member to which the cleat 4 is firmly attached, an outside left-hand portion 1L, and an inside right-hand portion 1R, which are separated by the left and right lateral lines 6L and 6R.

The cleat 4 is directly fixed to the middle portion 1R. The right-hand portion 1R and the left-hand portion 1L are injection-molded integrally with the middle portion 1M. The middle portion 1M is molded by the monolithic injection molding of a material that is different from and harder than that of the left-hand portion 1L or right-hand portion 1R. The left-hand portion 1L and right-hand portion 1R are directly joined to the middle portion 1M by a thin component 7L and a thin component 7R, respectively.

FIG. 7 is a is a plan view of another alternative embodiment of a snowboard boot sole according to the present invention, and FIG. 8 is a cross sectional view of the sole core taken along line VIII—VIII in FIG. 7. The overall shape of the sole core member 1 is essentially the same as that of a conventional member. The sole core member 1 is divided into three portions in the two positions occupied by left and right lateral lines 6L and 6R, which are shifted to the left and right from the center line L. More specifically, the sole core member 1 comprises a middle portion 1M, which is the portion of the sole core member to which the cleat 4 is firmly attached, an outside left-hand portion 1L, and an inside right-hand portion 1R, which are separated by the left and right lateral lines 6L and 6R. The cleat 4 is directly fixed to the middle portion 1R.

The right-hand portion 1R and the left-hand portion 1L are injection-molded as separate components from the same material. In this embodiment, the left-hand portion 1L and the middle portion 1M are completely separated into portions lying to the left and right of the left lateral line 6L. Similarly, the right-hand portion 1R and the middle portion 1M are completely separated into portions lying to the left and right of the right lateral line 6R.

FIG. 9 shows a coordinate system for the proposed cleat position structure for a snowboard boot. The edges (left and right edges, as seen in the traveling direction) of a snowboard are designated by Nos. 11 and 12. The edges 11 and 12 are roughly parallel to each other in the positions indicated, and they are roughly parallel to the traveling direction X.

It is difficult to define the longitudinal direction of a boot using the concept of a single foot. However, the definition can be made using the concept of two feet as long as the two boots are symmetrical. FIG. 9 pertains to a case that involves only the left foot. A right foot portion indicated with a hypothetical line is merely shown for the sake of convenience to allow the center line to be defined by association with the left foot portion in the same drawing.

Each boot is inserted into a slider comprising a first slider and a second slider. The first slider has facing flat surfaces that can move crosswise in relation to each other and that are orthogonal to the direction of travel. The second slider is tightly fitted between the facing surfaces at any distance between the surfaces, is guided by the facing surfaces, and is allowed to slide in the direction orthogonal to the aforementioned direction of travel. When each boot is held in the second slider, the right and left points Q in FIG. 9 are superposed on line S. In this case, line S is one about which the left and right boots have line symmetry.

O is the point of intersection of two medians: a first median (center line) between, first, the symmetry line S that passes through point Q and, second, a tangent that is parallel to such a symmetry line and that is drawn to the outline of the boot; and a second median of two lines that are orthogonal to the symmetry line S and that are tangent to the front and back of the boot. Any line that passes through this intersection point O and is parallel to the symmetry line S is, by definition, a center line L.

It is more practical, however, to define the longitudinal axis of a boot as a concept that has a broader meaning than that of a geometric center line, as will be described below. Line L depicted in the drawing will be referred to as a center line in a narrow sense, and will be referred to merely as "center line" unless specified to the contrary.

In FIG. 9, the left foot, which is more active, is positioned on a snowboard SN. The origin O lies on the center line of the snowboard. The line that passes through the origin O and that is parallel to the edges 11 and 12 of the snowboard SN is taken to be the X-axis. The line that passes through the origin O and that is orthogonal to the X-axis is taken to be the Y-axis.

The center line L is commonly inclined with respect to the Y-axis. The center line is inclined in such a way that the front portion of the foot is shifted in the traveling direction of the snowboard. The inclination between the Y-axis and the center line is often 28 degrees. This angle has been established on the basis of an empirical formula.

The boot may provided with a hinge portion to allow the boot to lean in the traveling direction while rotating around the center line L. There are snowboard boots in which the center line of rotation of the hinge portion is aligned with the center line L. In this case, any part of the snowboard boot can move forward in the traveling direction while rotating in a plane that is orthogonal both to the center line L and to the upper surface of the snowboard.

Such foot tilting is easy for a foot that is already inclined forward (forward on the center line L) but difficult for a foot that is not inclined forward, i.e., that is upright. For a foot that is inclined forward, it is easier to rotate around the core line T of an axis of rotation inclined at about 30 degrees to the center line L than to rotate around the center line L.

As a result of research, the inventor discovered that it is preferable for such a core line T of the axis of rotation to be inclined about 30 degrees clockwise with respect to the center line L. Another discovery made by the inventor as a result of research is that it is preferable for the core line T of the axis of rotation to be positioned behind the Y-axis (in relation to the traveling direction X).

The angle between the core line T of rotation and the center line L is expressed as $\alpha$. Let us define the longitudinal axis (which may correspond to the core line T) using inclination $\alpha$.

$$0<\beta<\alpha,$$

where $\beta$ is the angle between the longitudinal axis and the center line in a narrow sense. The inclination $\beta$ of such a longitudinal axis may be essentially zero.

The core line T of rotation shown is inclined 30 degrees clockwise with respect to the center line L in a narrow sense. The core line T of the axis of rotation is therefore inclined 2 degrees clockwise with respect to the Y-axis. In other words, the core line T of rotation is roughly orthogonal to the X-axis, which is the major axis of the snowboard.

When a foot that is tilted forward is rotated forward in the traveling direction around the core line T of rotation, an arbitrary part of the foot moves forward in the traveling direction while rotating in a plane that is orthogonal to the snowboard SN and that is roughly parallel to the X-axis. The propulsive force created by the movement of the foot is transmitted to the snowboard via the sole core member 1 equipped with a firmly fixed cleat or via the middle portion 1M, the cleat, and the engagement mechanism of the sole core member. Because the propulsive force thus transmitted is directed roughly along the X-axis, the transmission efficiency of the propulsive force is high. The sole core member to which a cleat has been firmly fixed is positioned only in the central portion of the foot sole, making it possible for the central portion to function as an axis of rotation with considerable torsional elastic force. When this central portion is directed along the center line in a broad sense, the torsional elastic force of the central portion increases the propulsive force component in the direction of the X-axis.

While the above is a description of various embodiments of the present invention, various modifications may be employed without departing from the spirit and scope of the present invention. Thus, the scope of the invention should not be limited to the specific embodiments described. Instead, the scope of the invention should be determined by the following claims.

What is claimed is:

1. A sole for a snowboard boot comprising:

a continuous sole member having a front edge, a rear edge, a left lateral edge, and a right lateral edge;

a sole core member extending continuously with the sole member along a longitudinal center core line (T) to the front edge and to the rear edge of the sole member, wherein the sole core member is stiffer than the sole member, wherein a left edge the sole core member is spaced apart from the left lateral edge of the sole member, and wherein a right edge of the sole core member is spaced apart from the right lateral edge of the sole member.

2. The sole according to claim 1 wherein the sole member has a longitudinal center line (L), and wherein the longitudinal center core line (T) is inclined relative to the longitudinal center line (L).

3. The sole according to claim 2 wherein the longitudinal center core line (T) is inclined relative to the longitudinal center line (L) by not more than 30 degrees.

4. The sole according to claim 1 wherein at least one of the left edge and the right edge of the sole core member is substantially straight along substantially its entire length.

5. The sole according to claim 1 wherein the sole core member is formed of a resin material.

6. The sole according to claim 1 wherein the sole core member is harder than a material forming the sole member between the left edge of the sole core member and the left lateral edge of the sole member, and wherein the sole core member is harder than the material forming the sole member between the right edge of the sole core member and the right lateral edge of the sole member.

7. The sole according to claim 1 wherein the sole core member includes a cleat attachment hole for attaching a cleat to the sole core member.

8. The sole according to claim 1 wherein the sole core member extends to front and rear edges of the sole member.

9. A sole for a snowboard boot comprising:

a continuous sole member having a front edge a rear edge a left lateral edge, and a right lateral edge;

a central sole core member extending continuously with the sole member to the front edge and to the rear edge of the sole along a longitudinal center core line (T);

a left side sole core member extending continuously with the sole member to the front edge and to the rear edge of the sole member along a left side of the central core member;

a right side sole core member extending continuously with the sole member to the front edge and to the rear edge of the sole member along a right side of the central core member; and wherein the central sole core member is harder than the left side sole core member and the right side sole core member.

10. The sole according to claim 9 wherein the sole member has a longitudinal center line (L), and wherein the longitudinal center core line (T) is inclined relative to the longitudinal center line (L).

11. The sole according to claim 10 wherein the longitudinal center core line (T) is inclined relative to the longitudinal center line (L) by not more than 30 degrees.

12. The sole according to claim 9 wherein at least one of the left edge and the right edge of the central sole core member is substantially straight along substantially its entire length.

13. The sole according to claim 9 wherein the central sole core member is formed of a resin material.

14. The sole according to claim 9 wherein the central sole core member includes a cleat attachment hole for attaching a cleat to the central sole core member.

15. The sole according to claim 9 wherein the central sole core member extends to front and rear edges of the sole member.

16. The sole according to claim 15 wherein the left side sole core member and the right side sole core member both extend to the front and rear edges of the sole member.

17. A sole for a snowboard boot comprising:

a continuous sole member having a front edge, a rear edge, a left lateral edge, and a right lateral edge;

a central sole core member extending continuously with the sole member to the front edge and to the rear edge of the sole along a longitudinal center core line (T);

a side sole core member extending continuously with the sole member to the front edge and to the rear edge of the sole member along a side of the central core member; and wherein the central sole core member is harder than the side sole core member.

* * * * *